US010989209B2

(12) United States Patent
Xing et al.

(10) Patent No.: US 10,989,209 B2
(45) Date of Patent: Apr. 27, 2021

(54) FAN

(71) Applicant: BEIJING XIAOMI MOBILE SOFTWARE CO., LTD., Beijing (CN)

(72) Inventors: Zheng Xing, Beijing (CN); Lei Zhang, Beijing (CN); Zhenhua Liu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 155 days.

(21) Appl. No.: 16/125,778

(22) Filed: Sep. 10, 2018

(65) Prior Publication Data

US 2019/0101127 A1 Apr. 4, 2019

(30) Foreign Application Priority Data

Sep. 30, 2017 (CN) ..... 201710944901.X

(51) Int. Cl.

| | |
|---|---|
| ***F04D 25/10*** | (2006.01) |
| ***F04D 19/00*** | (2006.01) |
| ***F04D 29/70*** | (2006.01) |
| ***F04D 27/00*** | (2006.01) |
| ***F04D 29/52*** | (2006.01) |
| ***F04D 25/06*** | (2006.01) |

(52) U.S. Cl.

CPC ..... *F04D 25/105* (2013.01); *F04D 19/002* (2013.01); *F04D 25/0673* (2013.01); *F04D 25/0693* (2013.01); *F04D 25/10* (2013.01); *F04D 27/007* (2013.01); *F04D 29/522* (2013.01); *F04D 29/703* (2013.01)

(58) Field of Classification Search

CPC ..... F04D 25/10; F04D 25/105; F04D 25/002; F04D 25/0673; F04D 25/0693; F04D 19/002; F04D 27/007; F04D 29/60; F04D 29/601; F04D 29/64; F04D 29/644; F04D 29/522; F04D 29/703

See application file for complete search history.

(56) References Cited

U.S. PATENT DOCUMENTS

| | | | | |
|---|---|---|---|---|
| 2,434,130 | A * | 1/1948 | Turner | 416/246 |
| 5,337,994 | A | 8/1994 | Vipond et al. | |
| 5,344,287 | A * | 9/1994 | Schaefer | F04D 29/601 415/213.1 |
| 7,311,492 | B2 * | 12/2007 | Ostberg | F04D 29/4226 415/126 |
| 9,175,697 | B1 * | 11/2015 | Kadau | F04D 29/644 |
| 10,746,193 | B2 * | 8/2020 | Park | F24F 13/28 |

(Continued)

OTHER PUBLICATIONS

European Patent Office, Extended European Search Report Issued in Application No. 18197658.0, dated Mar. 6, 2019, Germany, 6 pages.

*Primary Examiner* — Justin D Seabe
*Assistant Examiner* — Ryan C Clark
(74) *Attorney, Agent, or Firm* — Syncoda LLC; Feng Ma

(57) ABSTRACT

A fan includes a fan seat and a fan head, wherein a first surface of the fan head opposed a second surface of the fan seat. The fan further includes a first rotating shaft at edges of the first surface and the second surface configured to rotatably couple the fan seat and the fan head, such that the first surface of the fan head and the second surface of the fan seat form an target angle based on the first rotating shaft.

18 Claims, 5 Drawing Sheets

(56) References Cited

U.S. PATENT DOCUMENTS

| | | | | |
|---|---|---|---|---|
| 2013/0108481 | A1* | 5/2013 | Hoye | F04D 25/084<br>417/234 |
| 2015/0017028 | A1* | 1/2015 | Hodgson | F04D 25/105<br>417/84 |
| 2015/0247644 | A1 | 9/2015 | Stearns | |
| 2016/0363341 | A1* | 12/2016 | Arens | F24F 7/007 |
| 2019/0003480 | A1* | 1/2019 | Hall | F24F 11/58 |

* cited by examiner

FAN

CROSS-REFERENCE TO RELATED APPLICATIONS

This application claims priority to Chinese Patent Application No. 201710944901.X filed on Sep. 30, 2017, the entire content of which is incorporated herein by reference for all purposes.

BACKGROUND

A user may use winds blown by a floor fan to accelerate an air flow in an indoor space, thereby achieving a purpose of indoor heat dissipation. When the user needs to dissipate heat for a small space, a small USB (Universal Serial Bus) fan may be used, and the small USB fan is directed to a position where heat dissipation is required, so as to achieve a purpose of cooling as much as possible.

SUMMARY

In an aspect, a fan is provided. In some embodiments, the fan includes a fan seat and a fan head, where a first surface of the fan head is disposed opposite to a second surface of the fan seat.

In some embodiments, the fan further includes a first rotating shaft, wherein the first rotating shaft is provided at edges of the first surface and the second surface to rotatably connect the fan seat and the fan head, such that the first surface of the fan head and the second surface of the fan seat form an target angle based on the first rotating shaft.

In some embodiments, the first rotating shaft is configured to allow a power supply line to pass therethrough, and the power supply line is configured to supply power to the fan head.

In some embodiments, the fan seat includes: a first seat body; and a second seat body, wherein a bottom surface of the second seat body is opposing a top surface of the first seat body, and a top surface of the second seat body is the second surface of the fan seat.

In some embodiments, the second seat body is rotatable relative to the first seat body.

In some embodiments, the first rotating shaft is perpendicular to a rotating shaft between the second seat body and the first seat body.

In some embodiments, the fan seat further comprises a second rotating shaft, the second rotating shaft is fixedly connected to the first seat body, and the second rotating shaft is disposed at a center position of the second seat body such that the second seat body is rotatable about the second rotating shaft.

In some embodiments, the fan seat further includes: a third rotating shaft fixedly connected to the second seat body; and a steering motor configured to drive the second seat body to rotate relative to the first seat body by driving the third rotating shaft.

In some embodiments, the fan seat further includes: a third rotating shaft fixedly connected to the first base; and a steering motor configured to drive the first seat body to rotate relative to the second seat body by driving the third rotating shaft.

In some embodiments, the fan further includes: a plug fixed to a bottom of the fan seat; and a receiving portion disposed at the bottom of the fan seat configured to receive the plug.

In some embodiments, the fan further includes: a plug electrically connected to a bottom of the fan seat by a cable; and a receiving portion disposed at the bottom of the fan seat for receiving the cable with the plug.

In some embodiments, the fan further includes one or more dampers disposed at junctions of the first rotating shaft with the fan head and the fan seat and configured to provide a frictional force to thereby configure the fan head and the fan seat to the target angle formed.

In some embodiments, the target angle is equal or greater than to zero degrees and less than or equal to ninety degrees.

In some embodiments, the fan head includes: fan blades; and a speed regulating motor electrically coupled to the fan blades and configured to adjust rotation speed of the fan blades.

In some embodiments, the fan head further comprises: a housing middle frame; and a protective cover, wherein the fan blades and the speed regulating motor are located in a receiving space formed by the housing middle frame and the protective cover.

In some embodiments, the fan further includes a fan switch, wherein at least a portion of the fan switch protrudes from the second surface of the fan seat.

In some embodiments, the fan is in a closed state when the target angle between the first surface of the fan head and the second surface of the fan seat is zero degree.

In some embodiments, the fan further includes: a communication portion configured to couple the fan and an external electronic device; and a control portion configured to control the fan according to a control command received from the external electronic device.

In some embodiments, the control command comprises at least one of a wind speed adjustment command, a fan steering command, or a fan switch command.

In another aspect, an electronic apparatus is provided including a removable fan including: a fan seat; a fan head having a first surface opposing a second surface of the fan seat; and a first rotating shaft provided at edges of the first surface and the second surface and configured to rotatably couple the fan seat and the fan head, such that the first surface of the fan head and the second surface of the fan seat form a target angle based on the first rotating shaft.

In another aspect, a kit is provided including: an electronic device; and a fan including: a fan seat; a fan head having a first surface opposing a second surface of the fan seat; and a first rotating shaft provided at edges of the first surface and the second surface and configured to rotatably couple the fan seat and the fan head, such that the first surface of the fan head and the second surface of the fan seat form a target angle based on the first rotating shaft; wherein the fan seat comprises: a first seat body; and a second seat body, wherein: a bottom surface of the second seat body is opposing a top surface of the first seat body, and a top surface of the second seat body is the second surface of the fan seat; the second seat body is rotatable relative to the first seat body; and the first rotating shaft is perpendicular to a rotating shaft between the second seat body and the first seat body.

According to various embodiments of the present disclosure, the fan may be switched in a variety of working modes by the relative rotation between the fan seat and the fan head. As such, a space occupied by the fan may be effectively reduced. In addition, it can be effectively ensured that the wind generated by the fan may be adjusted to the direction of the user.

It is to be understood that the above general description and the below detailed description are only illustrative and explanatory, and are not intended to limit the present disclosure.

BRIEF DESCRIPTION OF THE DRAWINGS

The accompanying drawings referred to in the specification are a part of this specification, and provide illustrative embodiments consistent with the disclosure and, together with the detailed description, serve to illustrate some embodiments of the disclosure.

DETAILED DESCRIPTION

Various embodiments of the present disclosure are described below with specific examples, and other advantages and effects of the present disclosure can be easily understood by those skilled in the field of technology from the contents disclosed in this specification. The following description refers to the accompanying drawings in which same numeral references in different drawings may represent the same or similar elements unless otherwise indicated. Apparently, the described embodiments are only a part of embodiments in the present disclosure, rather than all of them. The present disclosure can also be implemented or applied through different specific embodiments, and various details of the specification can also be modified or changed based on different viewpoints and applications without departing from the spirit of the present disclosure.

The terminology used in the present disclosure is for the purpose of describing a particular example only, and is not intended to be limiting of the present disclosure. The singular forms such as "a," 'said," and "the" used in the present disclosure and the appended claims are also intended to include multiple, unless the context clearly indicates otherwise. It is also to be understood that the term "and/or" as used herein refers to any or all possible combinations that include one or more associated listed items.

It is to be understood that although different information may be described using the terms such as first, second, third, etc. in the present disclosure, the information should not be limited to these terms. These terms are used only to distinguish the same type of information from each other. For example, the first information may also be referred to as the second information without departing from the scope of the present disclosure, and similarly, the second information may also be referred to as the first information. Depending on the context, the word "if" as used herein may be interpreted as "when" or "as" or "determining in response to."

Figure 1A:
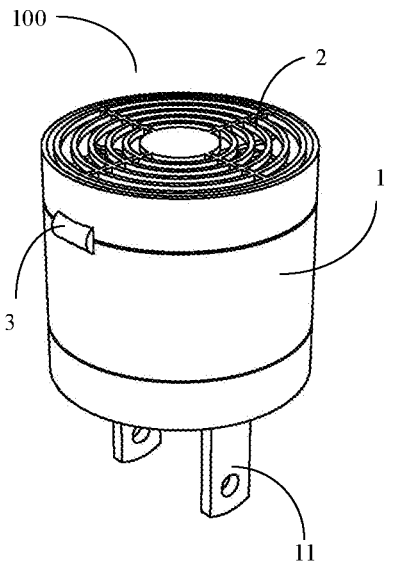
FIG. 1A is a schematic diagram illustrating a state of a fan according to some embodiments of the present disclosure.
Figure 1B:
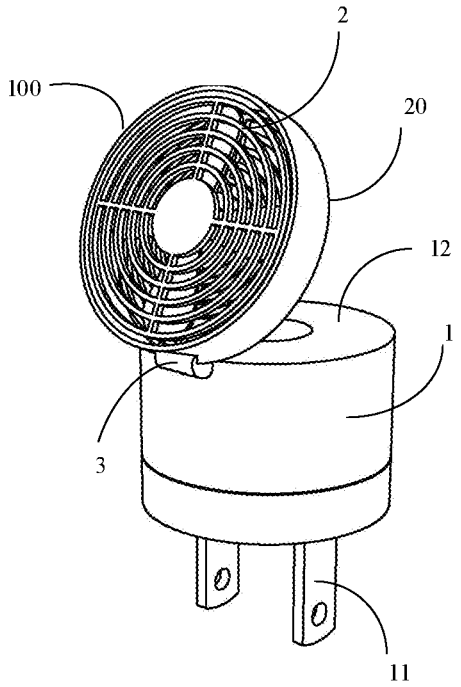
FIG. 1B is a schematic diagram illustrating another state of the fan shown in FIG. 1A.

FIG. 1A is a schematic diagram illustrating a state of a fan according to some embodiments of the present disclosure; FIG. 1B is a schematic diagram illustrating another state of the fan of FIG. 1A.

As shown in FIG. 1A and FIG. 1B, the fan 100 may include a fan seat 1 and a fan head 2. The fan seat 1 may include a plug 11 for powering the fan 100, specifically the fan head 2, by a cooperation of the plug 11 and an external socket. The fan head 2 may include a first surface 20 disposed opposite a second surface 12 on the fan seat 1. The first surface and the second surface 12 may be identical in size. The first surface 20 is rotatably connected with the second surface 12 at edges of the first surface 20 and the second surface 12, such that the first surface 20 of the fan head 2 and the second surface 12 of the fan seat 1 may abut on each other or separate from each other based on the joint.

The rotational connection between the fan seat 1 and the fan head 2 may be realized by means of a hinged connection, and of course, the fan seat 1 and the fan head 2 may also be connected by other means of rotational connection, which is not specifically limited in the disclosure.

In an example, as shown in FIG. 1A, with reference also to FIG. 1B, when the fan head 2 (or the fan seat 1) is adjusted such that the first surface 20 on the fan head 2 is disposed opposing the second surface 12 on the fan seat 1, the fan 100 may be in a first working mode to effectively reduce the occupied space of the fan 100 and is convenient to carry.

As shown in FIG. 1B, when the fan head 2 (or the fan seat 1) is adjusted such that the first surface 20 on the fan head 2 and the second surface 12 on the fan seat 1 are at a predetermined angle, the fan 100 may be in a second working mode such that the wind generated by the fan head 2 is directed toward the user.

In the embodiments as illustrated in FIG. 1A and FIG. 1B, a first rotating shaft 3 may be disposed between the fan seat 1 and the fan head 2. The first rotating shaft 3 is provided at edges of the first surface 20 and the second surface 12 to rotatably couple the first surface 20 of the fan head 2 and the second surface 12 of the fan seat 1.

In addition, the inside of the first rotating shaft 3 may allow a power supply line to pass through, thereby supplying power to the fan head 2, so as to control the start and stop of the fan head 2 and regulate the speed of the fan. For example, the power supply line may be a separate cable that is connected to the fan head 2 through a through hole provided in the first rotating shaft 3. Of course, the power supply line may also be an integrated module integrated on a flexible circuit board, which is not specifically limited in the disclosure.

Further, a damper may be provided at the joint between the fan head 2 and the fan seat 1. When an external force acting on the fan head 2 is strong enough to overcome the force generated by the damper due to damping, the fan head 2 may be lifted to form a target angle from the second surface 12 of the fan seat 1. In addition, when the external force is cancelled, the force generated by the damper may fix the fan head 2 at the target angle. For example, dampers made of a damping material such as rubber may be provided at the junctions of the first rotating shaft 3 with the fan head 2 and the fan holder 1, respectively, such that the fan head 2 may be fixed to an arbitrary target angle. Where the target angle may be any angle, for example, an angle less than or equal to 90 degrees.

Figure 2:
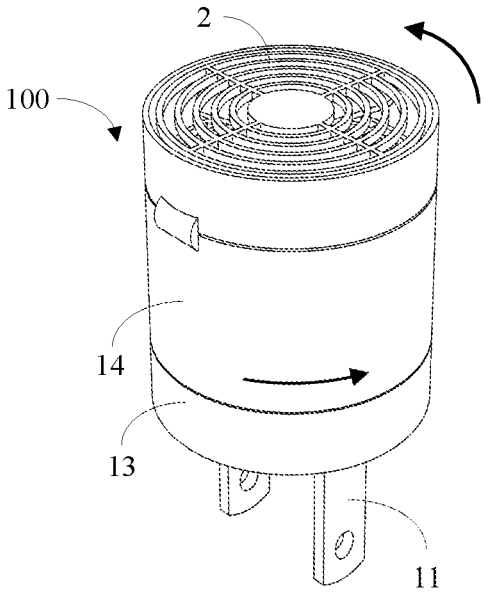
FIG. 2 is a schematic diagram illustrating a rotation of a fan according to some embodiments of the present disclosure.

FIG. 2 is a schematic diagram illustrating a rotation of a fan according to some embodiments of the present disclosure.

In each of the above examples, as shown in FIG. 1A, FIG. 1B and FIG. 2, the fan seat 1 may further include a first seat body 13 and a second seat body 14. A bottom surface of the second seat body 14 is disposed opposite to a top surface of the first seat body 13. A top surface of the second seat body 14 is the second surface 12 of the fan seat 1. The first seat body 13 and the second seat body 14 may rotate relative to each other, and the first rotating shaft 3 between the fan seat 1 and the fan head 2 is perpendicular to a relative rotation shaft between the first seat body 13 and the second seat body 14, so that the wind direction of the wind generated by the fan 100 may change with the relative rotation between the second seat body 14 and the first seat body 13, thereby effectively increasing an air supply range.

In an example, the inner space formed by the cooperation of the first seat body 13 and the second seat body 14 may be provided with a second rotating shaft 141. The second rotating shaft may be fixedly connected with the first seat body 13, and the second rotating shaft 141 is disposed at a center position of the second seat body 14. When an external force acts on the second seat body 14, the second seat body 14 may be rotated about the second rotating shaft 141, so as to achieve a purpose of adjusting the wind direction of the fan 100.

In another example, the inner space formed by the cooperation of the first seat body 13 and the second seat body 14 may be provided with a third rotation shaft 142. The third rotating shaft 142 is fixedly connected with the second seat body 14 or the first seat body 13, such that one of the first seat body 13 and the second seat body 14 may rotate about the third rotating shaft 142.

Figure 3:
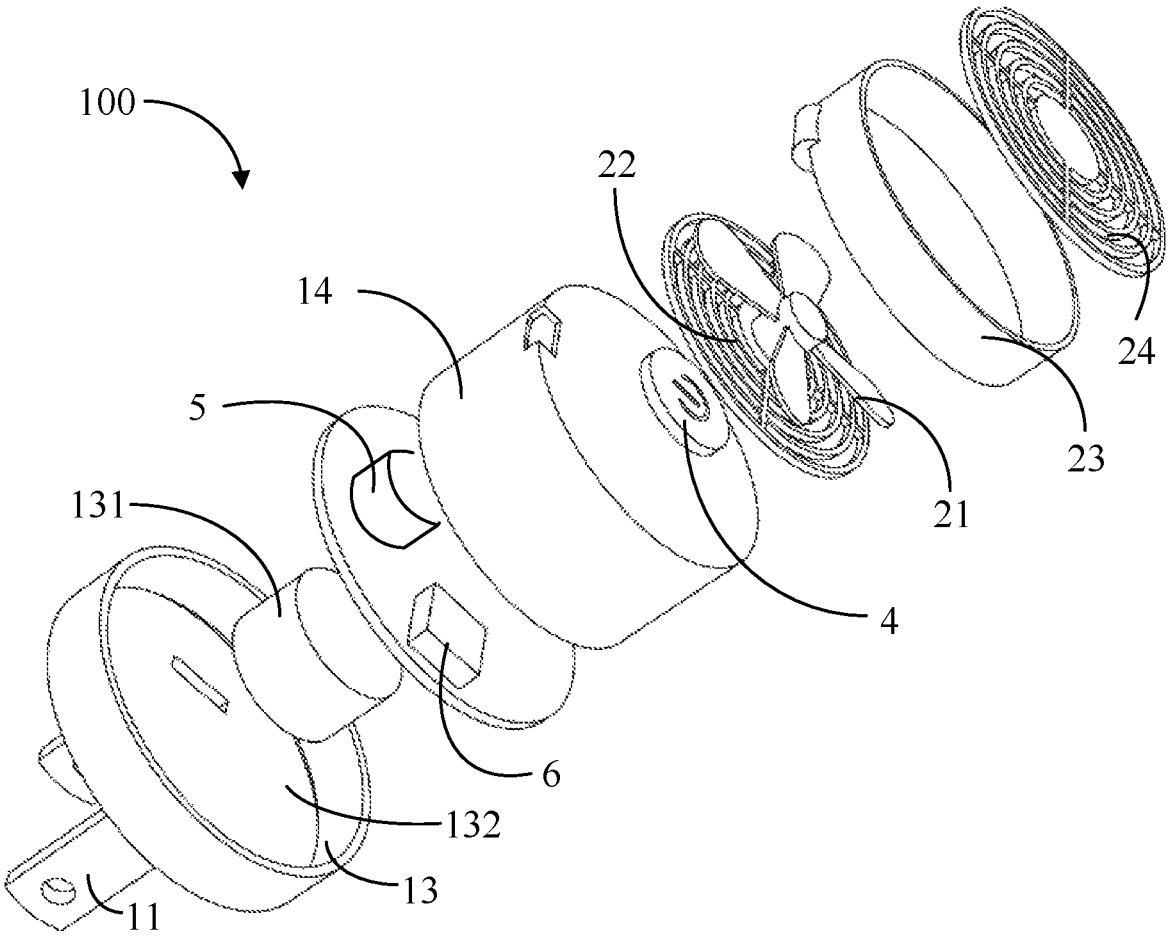
FIG. 3 is an exploded view of a fan according to some embodiments of the present disclosure.

FIG. 3 is an exploded view of a fan according to some embodiments of the present disclosure. As shown in FIG. 3, when the third rotating shaft 142 is fixedly connected to the second seat body 14, a steering motor 131 may be disposed in the first seat body 13. A power output shaft of the steering motor 131 is coupled to the second seat body 14 to drive the second seat body 14 to rotate relative to the first seat body 13. Where the power output shaft of the steering motor 131 may directly serve as the third rotating shaft.

Alternatively, the second seat body 14 may be driven to rotate relative to the first seat body 13 by decelerating or accelerating the power output shaft of the steering motor 131 with a multi-stage transmission member. In this case, the third rotating shaft is a rotating shaft on an end transmission member, which is not specifically limited in the disclosure.

Of course, the steering motor 131 may also be located within the second seat body 14. In this case, the power output shaft of the steering motor 131 is coupled to the first seat body 13 to drive the first seat body 13 to rotate relative to the second seat body 14.

In addition, the relative rotation between the first seat body 13 and the second seat body 14 may be counterclockwise or clockwise, which is not specifically limited in the disclosure.

In each of the above examples, as shown in FIG. 1A, FIG. 1B, FIG. 2, and FIG. 3, the plug 11 may be located at the bottom of the fan seat 1. In one example, the plug 11 may be fixed to the bottom of the first seat body 13 or may be electrically connected to the bottom of the first seat body 13 by a cable. In another example, the plug 11 may also be located on a side of the second seat body 14.

Figure 4:
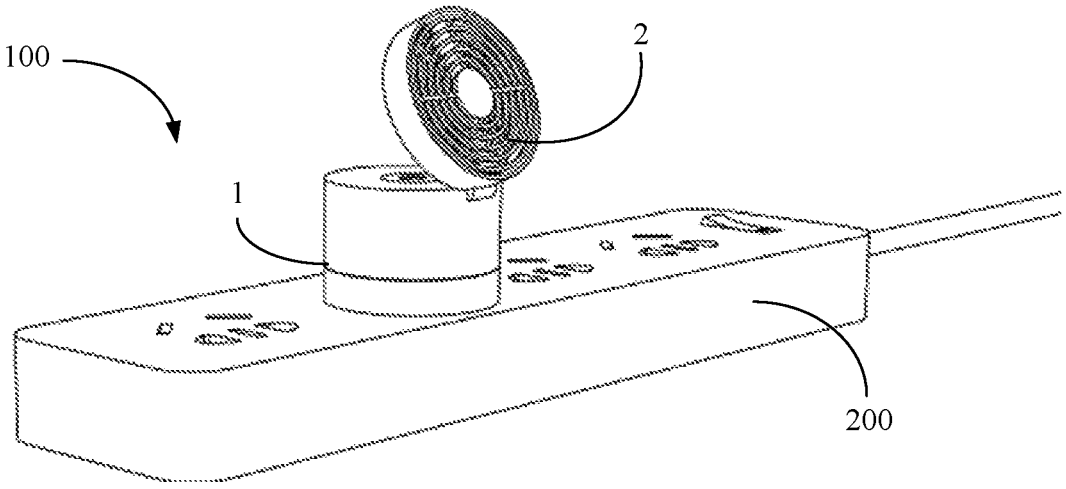
FIG. 4 is an assembly schematic diagram illustrating a fan and an external socket according to some embodiments of the present disclosure.

FIG. 4 is an assembly schematic diagram illustrating a fan and an external socket according to some embodiments of the present disclosure. In the above examples, when the fan 100 is directly plugged into an external socket 200 as shown in FIG. 4, the fan 100 may be designed as a "mini" type for use in office cubicles, on desks or computer desks, and the like.

Also, when the external socket 200 is set on a desktop or on a surface perpendicular to the desktop or other surfaces, the wind direction of the fan 100 may be adjusted to a target angle by adjusting the fan head 2. Further, the fan seat 1 may further include a receiving portion 132 that fits the plug 11. When the plug 11 is separated from a socket, the plug 11 or the cable with the plug 11 may be accommodated in the receiving portion 132, thereby effectively reducing wear and facilitating cleanliness of a room.

In an example, as shown in FIG. 3, the fan head 2 may further include blades 21 and a speed regulating motor 22. The speed regulating motor 22 is electrically connected to the blades 21, so that the rotational speed of the blades 21 may be adjusted. The fan head 2 may further include a housing middle frame 23 and a protective cover 24. The fan blades 21 and the speed regulating motor 22 may be located in the receiving space formed by the housing middle frame 23 and the protective cover 24, so as to avoid a case that a user's finger gets hurt by the blades 21.

Further, the fan 100 may also include a fan switch 4 as shown in FIG. 3. At least a part of the fan switch 4 protrudes from the second surface 12 of the fan seat 1, and may be used to switch the power state of the fan 100. In addition, when the first surface 20 of the fan head 2 abuts on the second surface 12 of the fan seat 1, the fan 100 may be in a closed state. In this way, when the user operates the fan switch 4, the fan head 2 needs to be fold to separate with the second surface 12 of the fan seat 1, thereby effectively reducing a risk of the user getting hurt by the fan blades 21 by mistake.

It should be noted that when the fan 100 includes the steering motor 131 and the speed regulating motor 22, the power states of the steering motor 131 and the speed regulating motor 22 may be controlled by the fan switch 4 simultaneously, or may be controlled through different fan switches, which is not specifically limited in the disclosure.

According to some embodiments of the present disclosure, still taking the implementation illustrated in FIG. 3 as an example, the fan 100 may further include a communication portion 5. The communication portion 5 may have a modular configuration, or may be made of discrete components, but nonetheless is referred to as a communication module 5.

Figure 5:
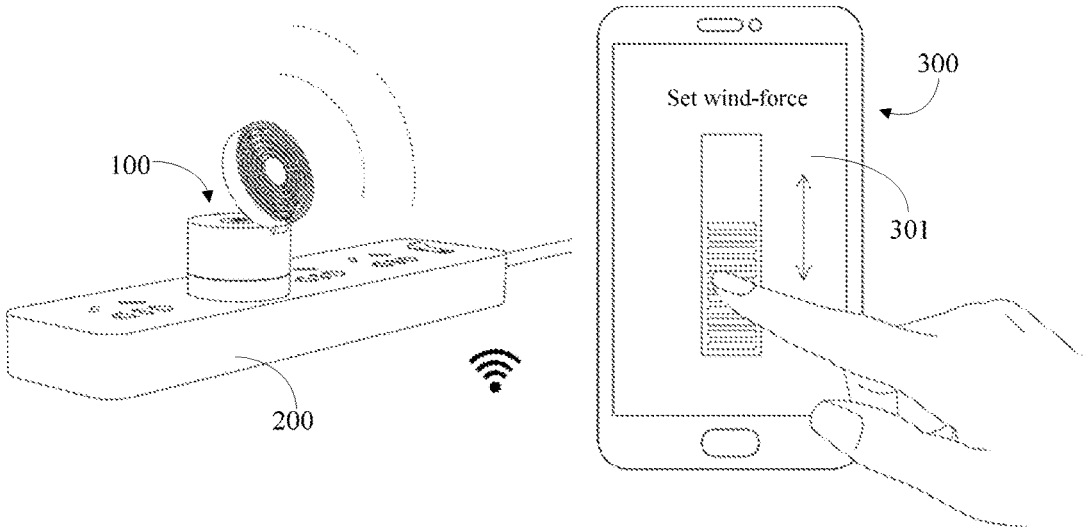
FIG. 5 is a schematic diagram illustrating an application scenario of a fan according to some embodiments of the present disclosure.

The communication module 5 may be employed to connect, wirelessly or through a cable, the fan 100 and an external electronic device 300 as shown in FIG. 5, thereby establishing a communication connection between them.

In one example, the communication module 5 can comprise a Wi-Fi module such that a wireless network connection may be established between the external electronic device 300 and the fan 100. Alternatively, the communication module 5 may also be a Bluetooth module configured to establish a Bluetooth connection between the external electronic device 300 and the fan 100.

Figure 6:
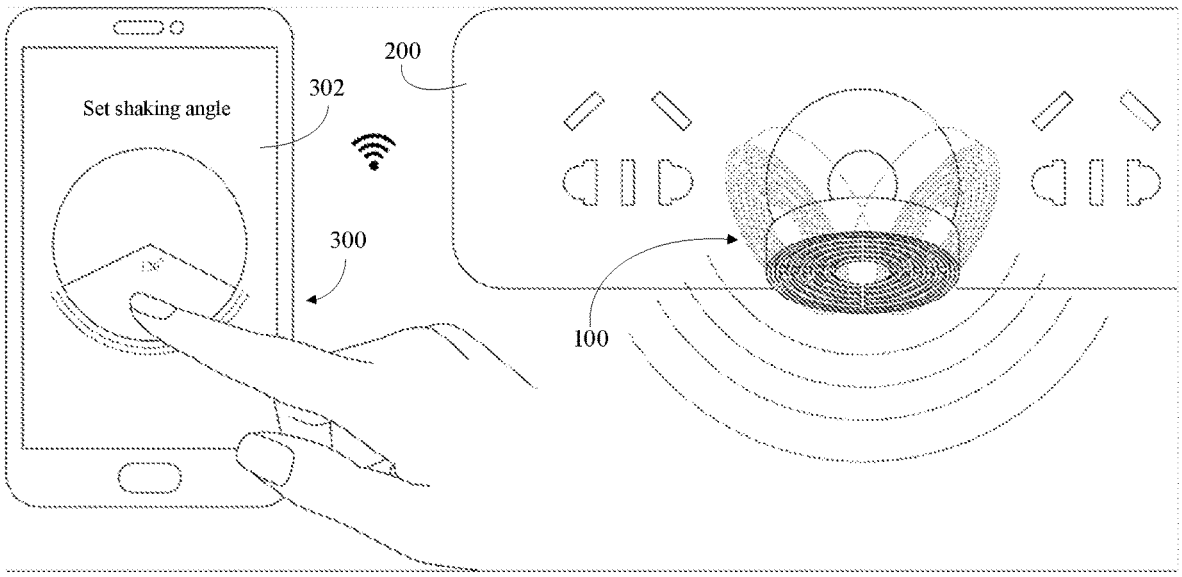
FIG. 6 is a schematic diagram illustrating an application scenario of a fan according to some other embodiments of the present disclosure.

FIG. 5 is a schematic diagram illustrating an application scenario of a fan according to some embodiments of the present disclosure. FIG. 6 is a schematic diagram illustrating an application scenario of a fan according to another example of the present disclosure.

Figure 7:
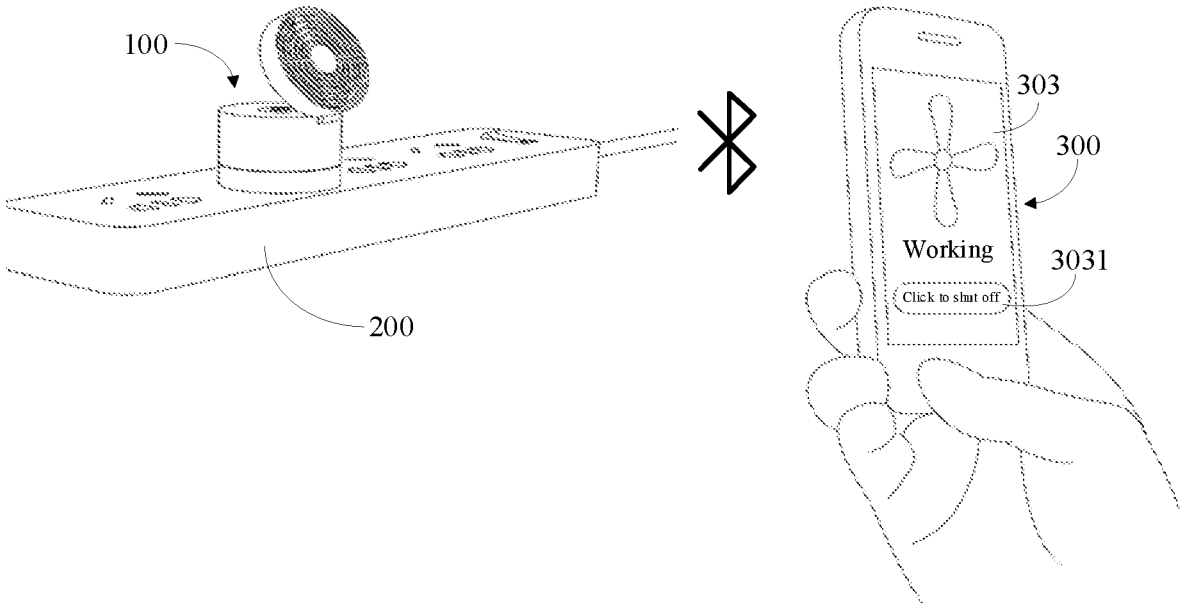
FIG. 7 is a schematic diagram illustrating an application scenario of a fan according to yet some other embodiments of the present disclosure.
Figure 8:
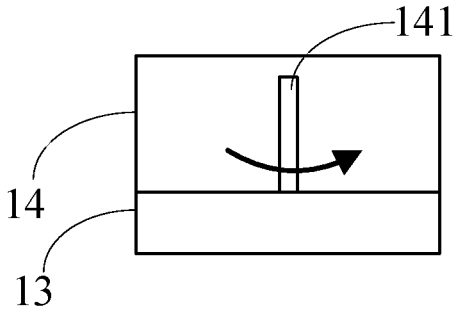
FIG. 8 is a schematic diagram illustrating a first sear body, a second seat body and a second rotating shaft according to some embodiments of the present disclosure.
Figure 9:
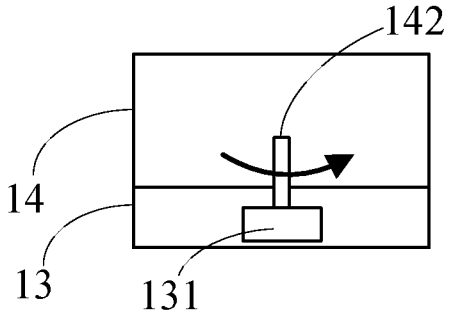
FIG. 9 is a schematic diagram illustrating a second seat body and a third rotating shaft according to some embodiments of the present disclosure.

FIG. 7 is a schematic diagram illustrating an application scenario of a fan according to yet some other embodiments of the present disclosure. The fan 100 may also include a control module 6, as shown in FIG. 3. In this way, the control module 6 may communicate with the external electronic device 300 through the communication module 5 to control the fan 100 according to a control command received from the external electronic device 300, thereby making the operation of the fan 100 more convenient and intelligent. In one example, the user may remotely operate the fan 100 to further enhance the user experience. In one example, the control module 6 may be integrated on a printed circuit board of the fan 100, which is not specifically limited in the disclosure.

In an example, the control command may be generated by the user triggering a virtual button of a preset application on the external electronic device 300. The preset application may be a system built-in program of the external electronic device 300 or a third-party application installed on the external electronic device 300. Of course, the control command may also be generated by the user triggering one or more physical buttons on the external electronic device 300, which is not specifically limited in the disclosure.

In some embodiments, the control command may include a wind speed adjustment command. For example, as shown in FIG. 5, the user may control the increase and decrease of the wind speed by "up-sliding" and "down-sliding" respectively on a wind speed regulating interface 301 of the external electronic device 300. Alternatively, the user may also control the increase and decrease of the wind speed by "left sliding" and "right sliding" respectively. Of course, the user may also adjust the wind speed in other ways, which will not be described one by one herein.

In another example, the control command may include a fan steering command. For example, as shown in FIG. 6, the user may set a swinging or shaking angle of the fan head 2 on a steering adjustment interface 302 of the external electronic device 300. The shaking angle may be input by the user on the steering adjustment interface 302, or the user may select a target shaking angle within a preset shaking angle range, such as a shaking angle of 120° or the like. The shaking angle limits a range of rotation of the first seat body 13 relative to the second seat body 14, for example, an arc-shaped region formed with the center of the rotation shaft of the first seat body 13 and the second seat body 14 as a center and a starting position of the first seat body 13 or the second seat body 14 as a boundary and covering a specific angle.

In still another example, the control command may include a fan switch command. For example, as shown in FIG. 7, the user may view running conditions of the fan 100 on a fan switch interface 303 of the external electronic device 300. When the running conditions of the fan 100 does not match the expected state, the power state of the fan 100 may be switched by adjusting a virtual button 3031 on the fan switch interface 303.

In some other embodiments, multiple control commands may also be transmitted simultaneously by the external electronic device 300. For example, the fan switch command and the fan steering command may be sent to the fan 100 when the user triggers the preset button, thereby further saving operation steps and optimizing the operation process. This is only an exemplary description, of course, the control commands may also be in various forms, which will not be described one by one herein.

In some embodiments, the external electronic device 300 can be a smart phone having installed there on a software program (e.g., an app) configured to execute the commands described above.

In some embodiments, the fan can be part of a kit, such as a travel kit for use by a user; or an electronic or toy kit, configured to be assembled by a user to become an electronic apparatus (such as a user-assembled computer) or a toy, where the fan provides cooling to selected electronic components and/or to the user.

In some embodiments, the kit can include the fan, and an electronic device such as the smart phone 300, where the smart phone 300 also can function as a controller of the fan as described above.

In some embodiments, the fan may be part of an electronic apparatus, such as a computer, a TV, a camera, a personal digital assistant, etc. The fan can be removably coupled to the electronic apparatus. For example, while plugged into the electronic apparatus, the fan can draw electricity from the electronic apparatus, such as from a USB port, while providing flexible and adjustable cooling airflow to the user. The fan can be removed from the electronic apparatus, and plugged into other electronic devices for example through the USB interface, or directly to a wall socket through its wall plug.

In some embodiments, the fan can have a battery, such as a built-in rechargeable battery that can be charged from the wall socket or from another electronic apparatus while plugged in, and can function with the battery power when unplugged.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A fan comprising:

a fan seat having a second surface;

a fan head having a first surface opposing the second surface of the fan seat; and a first rotating shaft provided at only one edge of the first surface of the fan head and only one edge of the second surface of the fan seat and configured to rotatably couple the fan seat and the fan head, such that an angle between the first surface of the fan head and the second surface of the fan seat is variable;

wherein the fan seat comprises:

a first seat body; and a second seat body, wherein a bottom surface of the second seat body is opposing a top surface of the first seat body, and a top surface of the second seat body is the second surface of the fan seat, and the second seat body is rotatable relative to the first seat body.

2. The fan according to claim 1, wherein:

the first rotating shaft is configured to allow a power supply line to pass therethrough, and the power supply line is configured to supply power to the fan head.

3. The fan according to claim 1, wherein the first rotating shaft is perpendicular to a rotating shaft between the second seat body and the first seat body.

4. The fan according to claim 1, wherein:

the fan seat further comprises a second rotating shaft, the second rotating shaft is fixedly connected to the first seat body, and the second rotating shaft is disposed at a center position of the second seat body such that the second seat body is rotatable about the second rotating shaft.

5. The fan according to claim 1, wherein the fan seat further comprises:

a third rotating shaft fixedly connected to the second seat body; and a steering motor configured to drive the second seat body to rotate relative to the first seat body by driving the third rotating shaft.

6. The fan according to claim 1, wherein the fan seat further comprises:

a third rotating shaft fixedly connected to the first seat body; and a steering motor configured to drive the first seat body to rotate relative to the second seat body by driving the third rotating shaft.

7. The fan according to claim 1, further comprising:

a plug fixed to a bottom of the fan seat; and a receiving portion disposed at the bottom of the fan seat configured to receive the plug.

8. The fan according to claim 1, further comprises:

a plug electrically connected to a bottom of the fan seat by a cable; and a receiving portion disposed at the bottom of the fan seat for receiving the cable with the plug.

9. The fan according to claim 1, further comprising one or more dampers disposed at junctions of the first rotating shaft with the fan head and the fan seat and configured to provide a frictional force to thereby configure the fan head and the fan seat to the target angle formed.

10. The fan according to claim 1, wherein the target angle is equal or greater than to zero degrees and less than or equal to ninety degrees.

11. The fan according to claim 1, wherein the fan head comprises:

fan blades; and a speed regulating motor electrically coupled to the fan blades and configured to adjust rotation speed of the fan blades.

12. The fan according to claim 11, wherein the fan head further comprises:

a housing middle frame; and a protective cover, wherein the fan blades and the speed regulating motor are located in a receiving space formed by the housing middle frame and the protective cover.

13. The fan according to claim 1, further comprising a fan switch, wherein at least a portion of the fan switch protrudes from the second surface of the fan seat.

14. The fan according to claim 1, wherein the fan is in a closed state when the target angle between the first surface of the fan head and the second surface of the fan seat is zero degree.

15. The fan according to claim 1, further comprising:

a communication portion configured to couple the fan and an external electronic device; and a control portion configured to control the fan according to a control command received from the external electronic device.

16. The fan according to claim 15, wherein the control command comprises at least one of a wind speed adjustment command, a fan steering command, or a fan switch command.

17. An electronic apparatus comprising a removable fan including:

a fan seat having a second surface;

a fan head having a first surface opposing the second surface of the fan seat; and a first rotating shaft provided at only one edge of the first surface of the fan head and only one edge of the second surface of the fan seat and configured to rotatably couple the fan seat and the fan head, such that the first surface of the fan head and the second surface of the fan seat form a variable target angle based on the first rotating shaft;

wherein the fan seat comprises:

a first seat body; and a second seat body, wherein a bottom surface of the second seat body is opposing a top surface of the first seat body, and a top surface of the second seat body is the second surface of the fan seat, and the second seat body is rotatable relative to the first seat body.

18. A kit comprising:

an electronic device; and a fan including:

a fan seat having a second surface;

a fan head having a first surface opposing the second surface of the fan seat; and a first rotating shaft provided at only one edge of the first surface of the fan head and only one edge of the second surface of the fan seat and configured to rotatably couple the fan seat and the fan head, such that an angle between the first surface of the fan head and the second surface of the fan seat is variable;

wherein the fan seat comprises:

a first seat body; and a second seat body, wherein:

a bottom surface of the second seat body is opposing a top surface of the first seat body, and a top surface of the second seat body is the second surface of the fan seat;

the second seat body is rotatable relative to the first seat body; and the first rotating shaft is perpendicular to a rotating shaft between the second seat body and the first seat body.

* * * * *